United States Patent [19]

Hutchins

[11] 4,440,445

[45] Apr. 3, 1984

[54] FLUID OUTLET AT THE BOTTOM OF AN IN SITU OIL SHALE RETORT

[75] Inventor: Ned M. Hutchins, Grand Junction, Colo.

[73] Assignee: Occidental Oil Shale, Inc., Grand Junction, Colo.

[21] Appl. No.: 326,143

[22] Filed: Nov. 30, 1981

Related U.S. Application Data

[63] Continuation-in-part of Ser. No. 204,641, Nov. 6, 1980, abandoned.

[51] Int. Cl.[3] ..... E21C 41/10

[52] U.S. Cl. ..... 299/2; 299/19

[58] Field of Search ..... 299/2, 19

[56] References Cited

U.S. PATENT DOCUMENTS

| | | | |
|---|---|---|---|
| 1,919,636 | 7/1933 | Karrick | 299/2 |
| 2,481,051 | 9/1949 | Uren | 299/2 |
| 3,001,776 | 9/1961 | Van Poollen | 299/2 |
| 4,043,595 | 8/1977 | French | 299/2 |
| 4,143,917 | 3/1979 | Sweany | 299/2 |
| 4,153,300 | 5/1979 | Kvapil et al. | 299/2 |
| 4,192,553 | 3/1980 | Studebaker et al. | 299/2 |
| 4,192,554 | 3/1980 | Ricketts | 299/2 |
| 4,239,285 | 12/1980 | French | 299/2 |
| 4,263,969 | 4/1981 | Ginsburgh | 299/2 |
| 4,269,449 | 5/1981 | del Rio | 299/2 |
| 4,357,051 | 11/1982 | Siegel | 299/2 |

*Primary Examiner*—Ernest R. Purser

*Attorney, Agent, or Firm*—Christie, Parker & Hale

[57] ABSTRACT

Formation is excavated from within the boundaries of a retort site in formation containing oil shale for forming at least one retort level void extending horizontally across the retort site, leaving at least one remaining zone of unfragmented formation within the retort site. A production level drift is excavated below the retort level void, leaving a lower zone of unfragmented formation between the retort level void and the production level drift. A plurality of raises are formed between the production level drift and the retort level void for providing product withdrawal passages distributed generally uniformly across the horizontal cross section of the retort level void. The product withdrawal passages are backfilled with a permeable mass of particles. Explosive placed within the remaining zone of unfragmented formation above the retort level void is detonated for explosively expanding formation within the retort site toward at least the retort level void for forming a fragmented permeable mass of formation particles containing oil shale within the boundaries of the retort site. During retorting operations products of retorting are conducted from the fragmented mass in the retort through the product withdrawal passages to the production level void. The products are withdrawn from the production level void.

24 Claims, 9 Drawing Figures

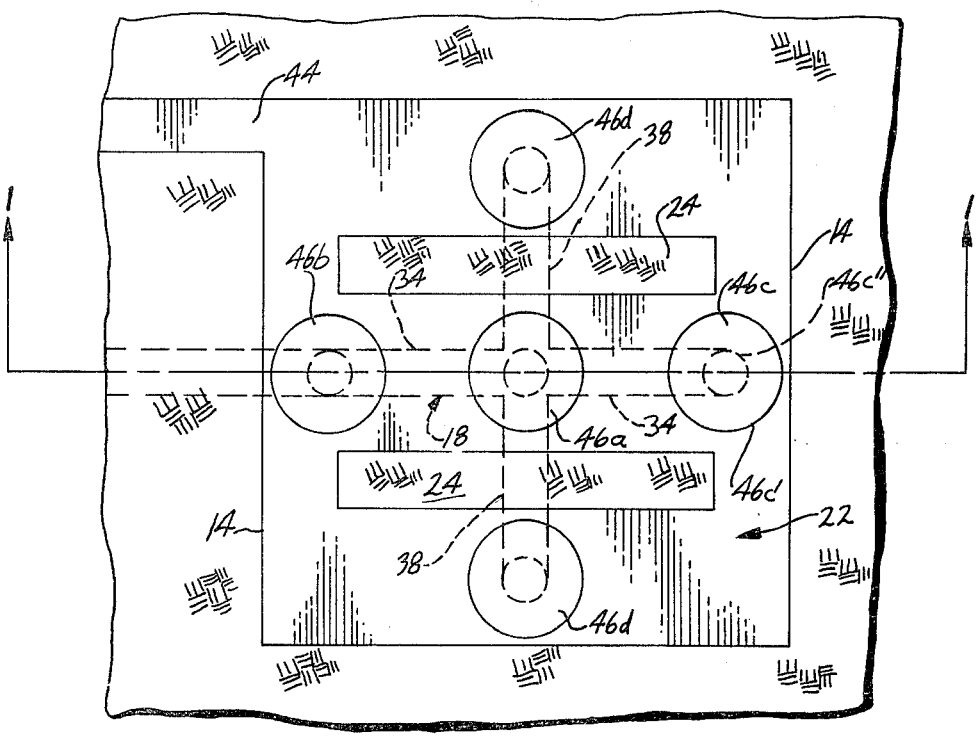
Fig. 2
Fig. 4
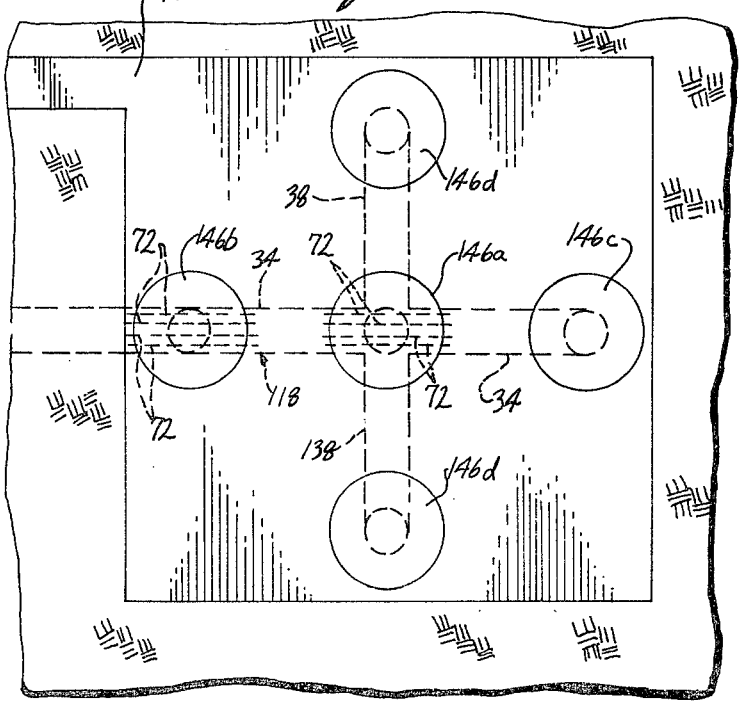

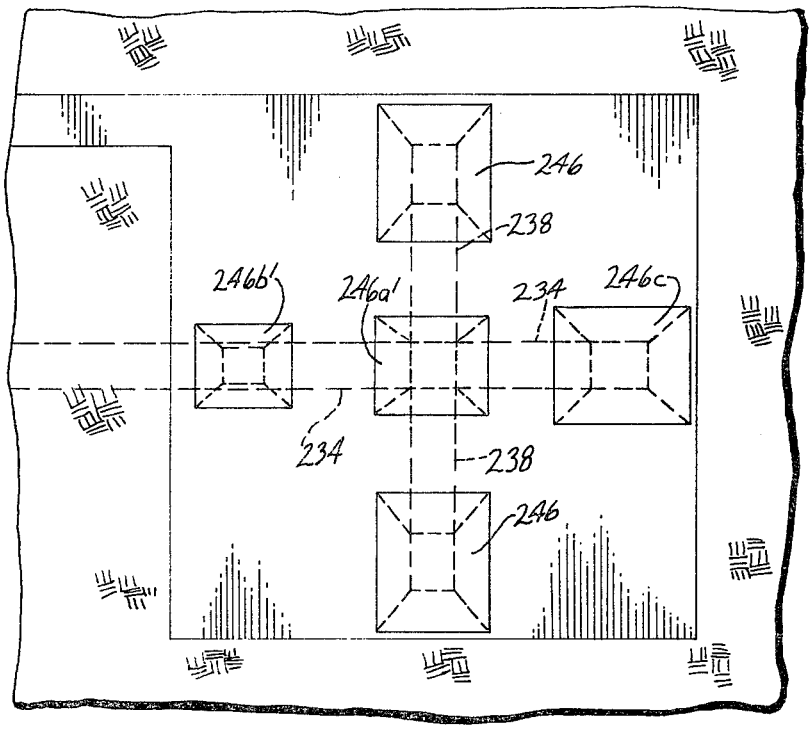
Fig. 5
Fig. 6
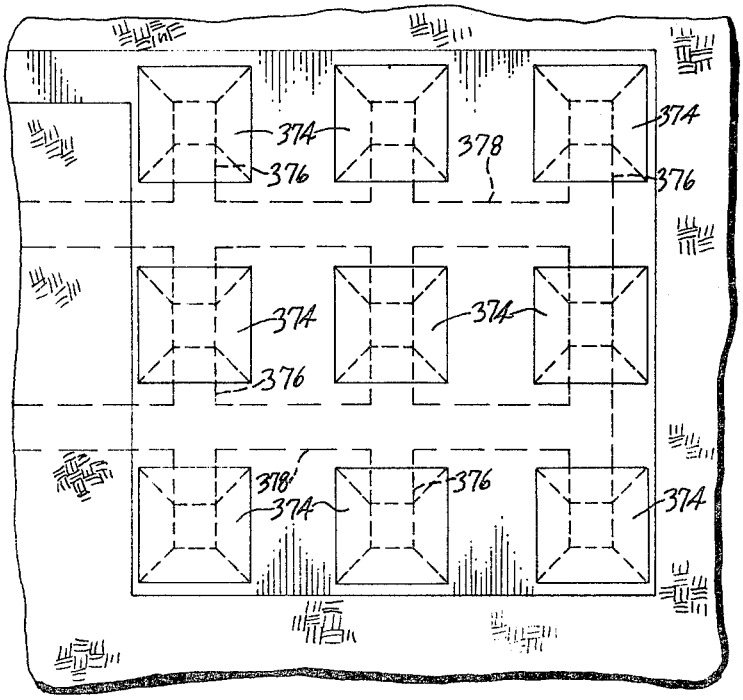

FLUID OUTLET AT THE BOTTOM OF AN IN SITU OIL SHALE RETORT

The Government of the United States of America has rights in this invention pursuant to Cooperative Agreement DE-FC20-78LC10036 awarded by the U.S. Department of Energy.

This application is a continuation-in-part of U.S. patent application Ser. No. 204,641, entitled FLUID OUTLET AT THE BOTTOM OF AN IN SITU OIL SHALE RETORT, filed Nov. 6, 1980 and now abandoned.

BACKGROUND OF THE INVENTION

This invention relates to withdrawal of liquid and gaseous products of retorting from an in situ oil shale retort.

Description of the Prior Art

The presence of large deposits of oil shale in the semi-arid high plateau region of the Western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer caled "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596, 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a stationary fragmented permeable mass of formation particles containing oil shale with the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous material to produce heat, combustion gas, and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable that oxygen-supplying gas flow relatively uniformly through a fragmented mass during retorting operations. Gas channeling through the fragmented mass can occur if there is non-uniform permeability in horizontal planes across the fragmented mass. By producing a generally uniform flow of gas across the horizontal cross-section of the fragmented mass during retorting, bypassing portions of the fragmented mass by retorting gas can be reasonably avoided, producing a reasonably uniform conversion of kerogen to liquid and gaseous products during retorting. Such a uniform conversion of kerogen to liquid and gaseous products can increase product yield from the fragmented mass when compared with a retort in which gas flow is not reasonably uniform.

In situ oil shale retorts have been devised with a drift communicating with the fragmented mass through a side boundary near the bottom of the retort. With such an arrangement, an appreciable quantity of oil shale in the fragmented mass can remain unretorted at the end of retorting operations. This problem can arise from several factors. Gas introduced into the fragmented mass tends to flow more or less directly toward the gas outlet. When the gas outlet is in the form of a drift opening through a side boundary of the retort, gas flow tends to concentrate toward that side of the retort, and an appreciable volume of oil shale adjacent the opposite side boundary near the bottom of the retort can be bypassed. Such oil shale bypassed by gas flow can remain unretorted. Further, in some techniques for forming the fragmented mass, some particles can flow or be driven into a drift communicating with the retort, resulting in a higher void fraction in a region above the drift than in other parts of the fragmented mass. Such a high void fraction can permit preferential gas flow or channeling and thereby bypass parts of the fragmented mass with lower void fraction. In addition, the off gas withdrawn from the retort cannot exceed a temperature that would damage off gas handling equipment. Therefore, it can be necessary to terminate retorting operations before the retorting zone reaches the bottom of the retort. This can occur when the retorting zone reaches the upper portion of the drift, in which case the oil shale at lower elevations may not be retorted.

The present invention provides a fluid outlet for withdrawing products of retorting from the bottom of an in situ oil shale retort with improved gas flow distribution near the bottom of the retort.

SUMMARY OF THE INVENTION

The present invention, according to one embodiment, provides a method for forming a fluid outlet at the bottom of an in situ oil shale formed in a subterranean formation containing oil shale. The in situ oil shale retort contains a fragmented permeable mass of formation particles containing oil shale. The fragmented mass is formed by excavating at least one retort level void in formation within the retort site, and excavating a production level drift or void in formation below the lower boundary of the retort site, leaving a lower zone of unfragmented formation between the retort level void and the production level void. A plurality of product withdrawal passages extend from the lower boundary of the retort site through the lower zone of unfragmented formation into the production level drift. A fragmented permeable mass of particles is placed in each of the product withdrawal passages. A remaining zone of unfragmented formation in the retort site is explosively expanded toward at least the retort level void for forming a fragmented permeable mass of formation particles containing oil shale within the retort site. Communication is provided between the fragmented mass in the retort and the production level void through the product withdrawal passages. Liquid and gaseous products of retorting formed in the fragmented mass during retorting operations are conducted to the production level drift through the product withdrawal passages.

By distributing a plurality of product withdrawal passages between the fragmented mass and the underlying production level void, reasonable uniformity of gas flow distribution across the horizontal cross-section of the fragmented mass can be obtained, so the volume of oil shale in the retort bypassed by flowing gas is minimized. This reduces the quantity of oil shale left unretorted and maximizes yield of the shale oil from the retort.

DRAWINGS

These and other aspects of the invention will be more fully understood by referring to the following detailed description and the accompanying drawings in which:

FIG. 2 is a fragmentary, semi-schematic horizontal cross-sectional view taken on line 2—2 of FIG. 1;

FIG. 5 is a fragmentary, semi-schematic horizontal cross-sectional view of an alternative embodiment of a lower portion of an in situ retort having product withdrawal passages of different sizes;

FIG. 6 is a fragmentary, semi-schematic horizontal cross-sectional view of a lower portion of the in situ retort illustrating a further alternative arrangement of product withdrawal passages;

FIG. 9 is an enlarged fragmentary vertical cross section of another embodiment of product withdrawal passage.

DETAILED DESCRIPTION

Figure 1:
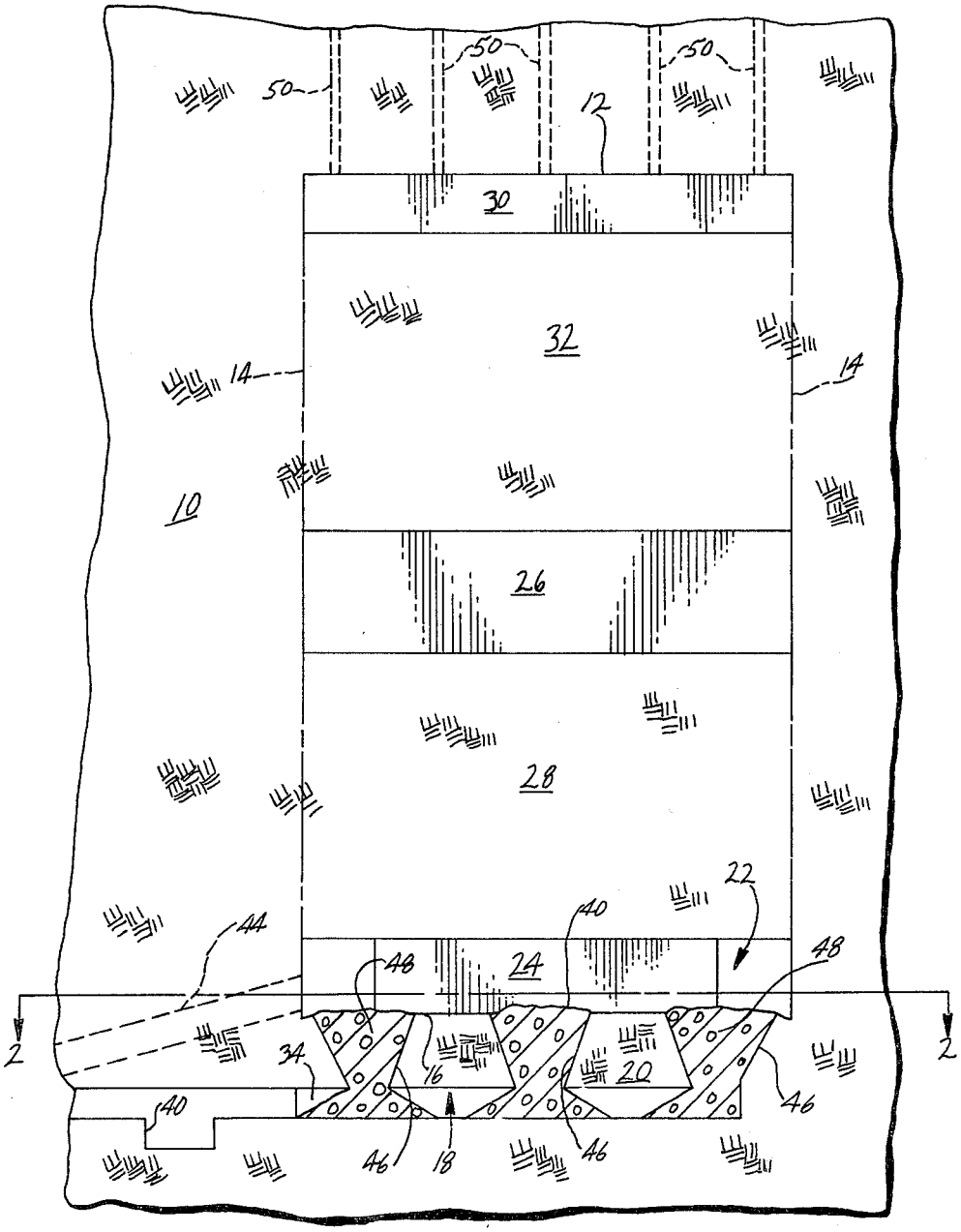
FIG. 1 is a fragmentary, semi-schematic vertical cross-sectional view taken on line 1—1 of FIG. 2 and showing an in situ oil shale retort having product withdrawal passages at the bottom according to principles of this invention.

FIG. 1 is a semi-schematic vertical cross section illustrating an in situ oil shale retort being formed in accordance with principles of this invention. The retort is being formed in a subterranean formation 10 containing oil shale. The in situ retort is rectangular in horizontal cross section, having an upper boundary 12, four vertically extending side boundaries 14, and a generally horizontal lower boundary 16. A drift system 18 at a production level spaced below the lower boundary of the retort site provides a region in which liquid and gaseous products of retorting are recovered during subsequent retorting operations in the in situ retort being formed. The production level drift system is excavated as a system of production level drifts described in more detail below. The roof of the production level drift system is spaced below the lower boundary of the retort being formed, leaving a horizontal lower zone 20 of unfragmented formation between the roof of the production level drifts and the lower boundary of the retort being formed.

The in situ retort ilustrated in FIG. 1 is formed according to a horizontal free face system in which formation is excavated from within the retort site for forming a plurality of vertically spaced apart retort level voids each extending horizontally across a different level of the retort site, leaving zones of unfragmented formation within the retort site between pairs of horizontal voids. In the illustrated horizontal free face system, a rectangular lower level void 22 is excavated adjacent the lower boundary of the retort site, with the side walls of the lower level void extending to the side boundaries of the retort site. A pair of temporary support pillars 24 are left in the lower level void for supporting overlying formation.

A rectangular intermediate void 26 is excavated at an intermediate level of the retort being formed, leaving a lower intervening zone 28 of unfragmented formation extending horizontally across the retort site between a horizontal free face of unfragmented formation below the intermediate level void and a horizontal free face above the lower level void. The intermediate level void also has side walls adjacent the side boundaries 14 of the retort site. One or more temporary support pillars (not shown) can be left in the intermediate level void for supporting overlying formation.

A rectangular upper level void 30 is excavated adjacent the top boundary 12 of the retort site, leaving an upper intervening zone 32 of unfragmented formation extending horizontally across the retort site between a horizontal free face of unfragmented formation above the intermediate level void and a horizontal free face below the upper level void. As in the underlying voids, the side boundaries of the upper level void extend to the side boundaries of the retort site, and one or more temporary support pillars (not shown) can be left in the upper level void for supporting overburden.

In the embodiment shown, the upper, intermediate and lower level voids all have a similar horizontal cross-sectional area, and the three voids are excavated directly above one another with their outer boundaries being in common vertical planes. In the illustrated embodiment, the intermediate level void 26 has a height approximately twice the height of either the upper level void or the lower level void. The upper, intermediate and lower level voids preferably occupy about 15% to about 30% of the total volume of formation within the boundaries of the retort being formed.

In the illustrated embodiment, the production level drift 18 comprises a plurality of drifts excavated at a production level below the lower boundary 16 of the retort site. The present invention facilitates use of a drift system at the production level with a combined horizontal cross-sectional area that is substantially less than the horizontal cross-sectional area of the retort being formed. As emphasized below, the invention facilitates use of a drift system at the production level, and avoids the need for a large production level void, i.e., a void having a horizontal cross-sectional area that approaches the horizontal cross-sectional area of the retort being formed.

Figure 3:
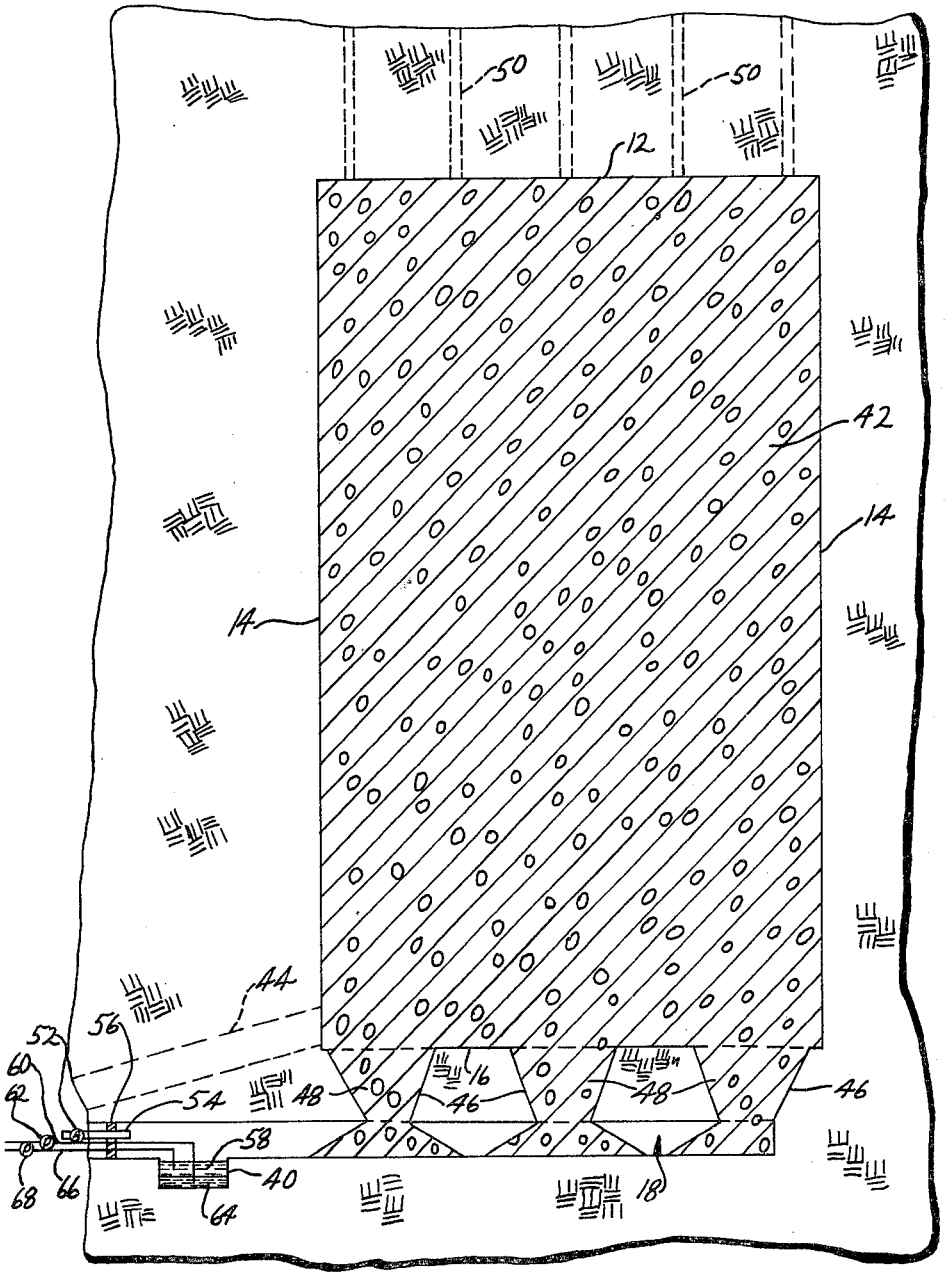
FIG. 3 is a fragmentary, semi-schematic vertical cross-sectional view showing a completed in situ retort formed according to principles of this invention.

The drift system at the production level also can be arranged in a variety of patterns. The system of FIGS. 1 through 3 is one example. As best illustrated in dashed lines in FIG. 2, the production level drift system comprises a pair of drifts that intersect one another at a right angle near the center of the retort, forming a generally cross-shaped production level drift system when viewed from above as in FIG. 2. The cross-shaped production level drift system includes a principal production level drift 34 excavated generally along the centerline of the retort from an access drift (not shown) spaced apart laterally from one side boundary of the retort site to an end near the opposite side boundary of the retort site. Beneath the center of the retort site the principal production level drift is branched into a pair of stub drifts or branch drifts 38 driven laterally outwardly at right angles from opposite sides of the principal drift from near the center of the retort to respective ends located near opposite side boundaries of the retort site.

A sump 40 is formed in a portion of the principal production level drift 34 for collecting liquid products of retorting, including shale oil, from a lower portion of a fragmented permeable mass of formation particles containing oil shale 42 (see FIG. 3) being formed within the upper, lower and side boundaries of the retort site. Another drift 44 is ramped upwardly from the access drift to provide access to the lower level void 24 for the mining operations necessary for forming the lower level void. In another embodiment, a drift (not shown) can be ramped downwardly to the production level drift from an access drift at the lower level of the retort.

A plurality of separate horizontally spaced apart raises 46 are excavated through the lower zone 20 of unfragmented formation between the production level drifts 18 and the lower level void 22. The raises can be excavated by boring between the lower level void and the production level drifts followed by enlargement by blasting, or they can be formed by other conventional raise forming techniques. Such a raise can be formed with a generally conical shape by fan drilling from the production level drift or by drilling blast holes downwardly from the lower level void.

These raises, which are also referred to herein as product withdrawal passages, provide separate means for conducting liquid and gaseous products of retorting from a lower portion of the fragmented mass 42 into the production level drift system. The product withdrawal passages are generally uniformly distributed across the horizontal cross-section of the lower level void; and in the embodiment best shown in FIG. 2, there are five such product withdrawal passages formed on a symmetrical "five-spot" pattern. The floor of the lower level void is generally horizontal, although such a generally horizontal floor can be sloped slightly, for example, toward the center of the retort, so that liquid products of retorting can flow toward passages opening generally through the lower portion of the sloped bottom of the retort being formed. A central product withdrawal passage **46*a* extends vertically into the production level near the center of the principal production level drift 34 where the stub drifts 38 open into the principal drift. An inner product withdrawal passage 46*b* extends vertically into the principal production level drift near the side boundary of the retort site closest to the access drift, and an outer product withdrawal passage 46*c* extends vertically into the end portion of the principal production level drift near the side boundary of the retort site farthest from the access drift. A pair of intermediate product withdrawal passages 46*d* extend into end portions of the lateral stub drifts 38** near the side boundaries of the retort site which are spaced apart laterally from the principal production level drift.

In one example, each of the product withdrawal passages is formed in the general shape of a truncated cone having its smaller end communicating with a production level drift and its larger end opening into the floor of the lower level void. Referring, for example, to the outer raise **46*c* in FIG. 2, each raise has a relatively larger generally circular opening or inlet 46*c*′ in the floor of the lower level drift 22 and a relatively smaller generally circular opening or outlet 46*c*″** opening through the roof or back of the production level drift system. Such product withdrawal passages can have other cross-sectional configurations, such as generally cylindrical, rectangular or square, for example. The conical passages are desirable because the increased cross-section to gas flow provided by the wider upper portions of the passages can reduce pressure drop of gas flowing through such a passage.

When such a product withdrawal passage is completed, the passage is backfilled with a fragmented permeable mass of particles 48. The particles in each passage extend from about the floor level of the lower level void through the entire depth of the passage and through the production level drift to the floor of the production level drift which supports the mass of particles contained in each passage. This arrangement is best shown in FIGS. 1 and 3. The fragmented permeable mass of particles in each product withdrawal passage can be fragmented permeable mass of formation particles containing oil shale. For example, the particles in the passage can be formed by leaving in place some of the rubble from forming the passage. Alternatively, other fragmented formation particles can be conveyed into the lower level void and dumped into the passages. When the latter technique is used, a relatively high void fraction can be obtained in the fragmented permeable mass of particles in the backfilled passages. Preferably, the average void fraction of the particles in the product withdrawal passages is higher than the average void fraction in the fragmented mass being formed in the retort. If desired, fine particles can be screened from the material dumped into the passages so that the fragmented mass in the passages has a higher average particle size than the average particle size of the fragmented mass 42 being formed in the retort. The large particle size and the high void fraction can reduce the pressure drop of gas flowing through such a passage.

In another embodiment as illustrated in FIG. 9, the tops of product withdrawal passages 75 can be covered with a structure for inhibiting flow of particles into the passages. For example, a separate grizzly 77 can be installed above each passage. The grizzly can be formed as a grid from criss-crossing metal bars, such as used railroad rails or an array of steel I-beams 79. Other similar means for reducing the cross section of the passage can be used, such as a coarse screen or a perforated cap.

In the embodiment illustrated in FIG. 9 the representative product withdrawal passage 75 is in the form of a cylindrical raise between the roof of a production level drift 81 and the floor 83 of an excavated void at the bottom boundary of an in situ oil shale retort. In an exemplary embodiment such a raise is about 8 feet in diameter and extends through about 20 to 60 feet of unfragmented formation. When such a raise is completed, it is backfilled with particles that can be readily withdrawn from the raise. For example, pea gravel 85 can be poured into the raise to form a pile at the angle of repose in the production level drift 81 and to fill the raise to about the level of the floor 83 of the excavated void. A grizzly in the form of an array of I-beams 79 is placed at the top of the raise. Preferably the I-beams are welded together such as by two or three overlying I-beams 73 and secured in place by rockbolting to the floor 83 to prevent inadvertent displacement during subsequent blasting. If desired the grizzly can be recessed a foot or two below floor level for protection of the grizzly during blasting. Additional gravel can be dumped through the grizzly to completely fill the raise and provide support for its walls during blasting.

When the product withdrawal passages have been filled with particles, the fragmented mass in the in situ oil shale retort can be formed. An array of vertically extending blast holes (not shown) can be drilled in the upper and lower intervening zones of unfragmented formation and loaded with the explosive charges. Explosive charges also are placed in the pillars, if any, in the evacuated voids. The explosive charges are detonated for explosively expanding the zones of unfragmented formation toward the horizontal free faces of formation adjacent the upper, intermediate and lower voids for forming the fragmented permeable mass 42 of formation particles containing oil shale within the boundaries of the in situ oil shale retort.

The fragmented mass is preferably formed in a single round of explosions, with the lower intervening zone being explosively expanded both upwardly toward the intermediate level void and downwardly toward the lower level void, and the upper intervening zone being explosively expanded both downwardly toward the intermediate level void and upwardly toward the upper level void. Explosive charges placed in the pillars within the voids are preferably detonated a short time interval before explosive in the zones of unfragmented formation is detonated for explosively expanding the pillars. The void volume initially present in the upper, intermediate and lower voids becomes interspersed throughout the formation particles in the fragmented mass following explosive expansion. Details of a technique for forming an in situ oil shale retort by explosive expansion toward free faces are presented in U.S. Pat. No. 4,192,554. In another embodiment, for example, a large undercut can be excavated in a lower region of the retort site and the remaining zone of formation within the boundaries of the retort site above the undercut can be blasted downwardly toward the undercut for forming the fragmented mass.

After forming the fragmented mass, the final preparation steps for producing liquid and gaseous products are carried out. These steps include drilling inlet holes 50 downwardly through the top boundary of the in situ oil shale retort site either before or after forming the fragmented mass. These holes provide inlet passages for introducing an oxygen-supplying gas, or other retort inlet mixture to the fragmented mass. Retorting operations are conducted by establishing a combustion zone in the fragmented mass and advancing the combustion zone downwardly through the fragmented mass. Combustion gas produced in the combustion zone passes through the fragmented mass to establish a retorting zone on the advancing side of the combustion zone, where kerogen in the oil shale is retorted to produce liquid and gaseous products of retorting. The liquid products including shale oil and the off gas containing gaseous products pass to the bottom of the fragmented mass and pass through each of the product withdrawal passages and the fragmented permeable masses of particles contained in the passages. The liquid products and the off gas containing gaseous products pass into the production level drifts and can be separately withdrawn. The bottom of the fragmented mass can have a slight slope toward one or more of the product withdrawal passages so that liquid products can preferably flow toward these passages. from the production level void. In the embodiment of FIG. 3, off gas is withdrawn from the production level drift by a blower 52 connected to a gas withdrawal line 54 sealed through a bulkhead 56 in the principal production level drift. Shale oil 58 which collects in the sump 40 is withdrawn by an oil withdrawal line 60 connected to an oil pump 62. Water 64 is withdrawn from the sump through a water line 66 connected to a water pump 68.

In an embodiment as illustrated in FIG. 9 one of the steps for preparing the retort for producing liquid and gaseous products comprises withdrawing the pea gravel 85 or other particles from the raise 75 after the fragmented mass of particles is formed in the retort. Fragmented formation can be supported by the grizzly 77 at the top of the product withdrawal passage. The open product withdrawal passage has less pressure drop than a similar size passage containing a fragmented mass of particles. It is therefore feasible to use a smaller passage than would be used if the raise contained a mass of particles. The temporary presence of the mass of particles during explosive expansion serves to protect the walls of the raise from collapsing during explosive expansion of overlying formation.

The product withdrawal passages are distributed on a generally uniform pattern across the horizontal cross section of the lower portion of the fragmented mass, which produces a reasonably uniform gas flow distribution across the entire horizontal cross section of the fragmented mass. As a result, the volume of oil shale bypassed by flowing gas is minimized. This reduces the quantity of oil shale left unretorted and maximizes yield of shale oil from the retort.

By providing a plurality of gas flow passages between the bottom of the fragmented mass and the underlying production level drifts, and by filling the passages with a fragmented permeable mass of particles, a large production level void can be avoided. Rather than excavating a relatively large production level void, i.e., one which approaches the horizontal cross-sectional area of the fragmented mass, a system of drifts of greatly reduced horizontal cross-sectional area, compared to the area of the fragmented mass in the retort, can be provided at the production level.

The product withdrawal passages are sufficiently large in total cross-sectional area to avoid creating an unreasonable constriction to gas flow between lower portions of the fragmented mass and the production level drifts. A large constriction to gas flow in the lower portion of the fragmented mass can increase total pressure drop through the retort. Product withdrawal passages occupying about 1% to about 25% of the horizontal cross-sectional area of the fragmented mass of particles in the retort produce acceptable gas flow rates at the bottom of the retort. Generally speaking, a raise or gas withdrawal passage is a bore hole or excavation with a width in the range of about 5 to about 20 feet, or more. In the square cross-sectional retort illustrated in FIGS. 1 through 3, for example, the product withdrawal passages can each be about 8 to 12 feet in diameter (at the minimum cross-sectional area), with the lower level void having dimensions of about 160 feet wide and 160 feet long.

In an embodiment wherein the mass of particles is left in the product withdrawal passages during operation of the retort, the void fraction of the permeable mass of particles in the product withdrawal passages is preferably greater than the void fraction in the fragmented mass in the retort. In one embodiment, the void fraction of the fragmented mass in the product withdrawal passages can be about 40%, whereas the void fraction in the fragmented mass can be about 25% to about 30%. This difference in permeability through the product withdrawal passages can provide additional means for avoiding a substantial constriction to gas flow from the lower portion of the fragmented mass to the production level drifts. Backfilling of the product withdrawal passage up to the vicinity of the floor of the lower level void permits control over the void fraction and particle size of the fragmented masses of particles in these passages. Backfilling the product withdrawal passages also minimizes presence of hazardous conditions in the lower level void as would be present with a large open raise. Further, backfilling the passages provides support for the walls of the passages during blasting and helps prevent variations in void fraction distribution in the fragmented mass being formed by leveling the floor of the lower level void. This produces a known void volume in the lower void prior to blasting for forming the fragmented mass in the retort and prevents flow of particles through the passages during subsequent explosive expansion, which, in turn, avoids creating a higher void fraction in the lower portion of the frgmented mass.

Other modifications of the invention also can be provided. For example, in the embodiment of FIGS. 1 through 3, off gas passing from the outer product withdrawal passage 46*c* and the intermediate passages 46*d* passes through a portion of the production level drift below the central passage 46*a* and the inner passage 46*b* nearest the access drift. If desired, the principal portion of the production level drift can be enlarged in vertical cross-section in the regions where the off gas passes beneath the passages 46*a* and 46*b* for reducing the gas flow velocity through the fragmented mass in the retort.

Figure 4:
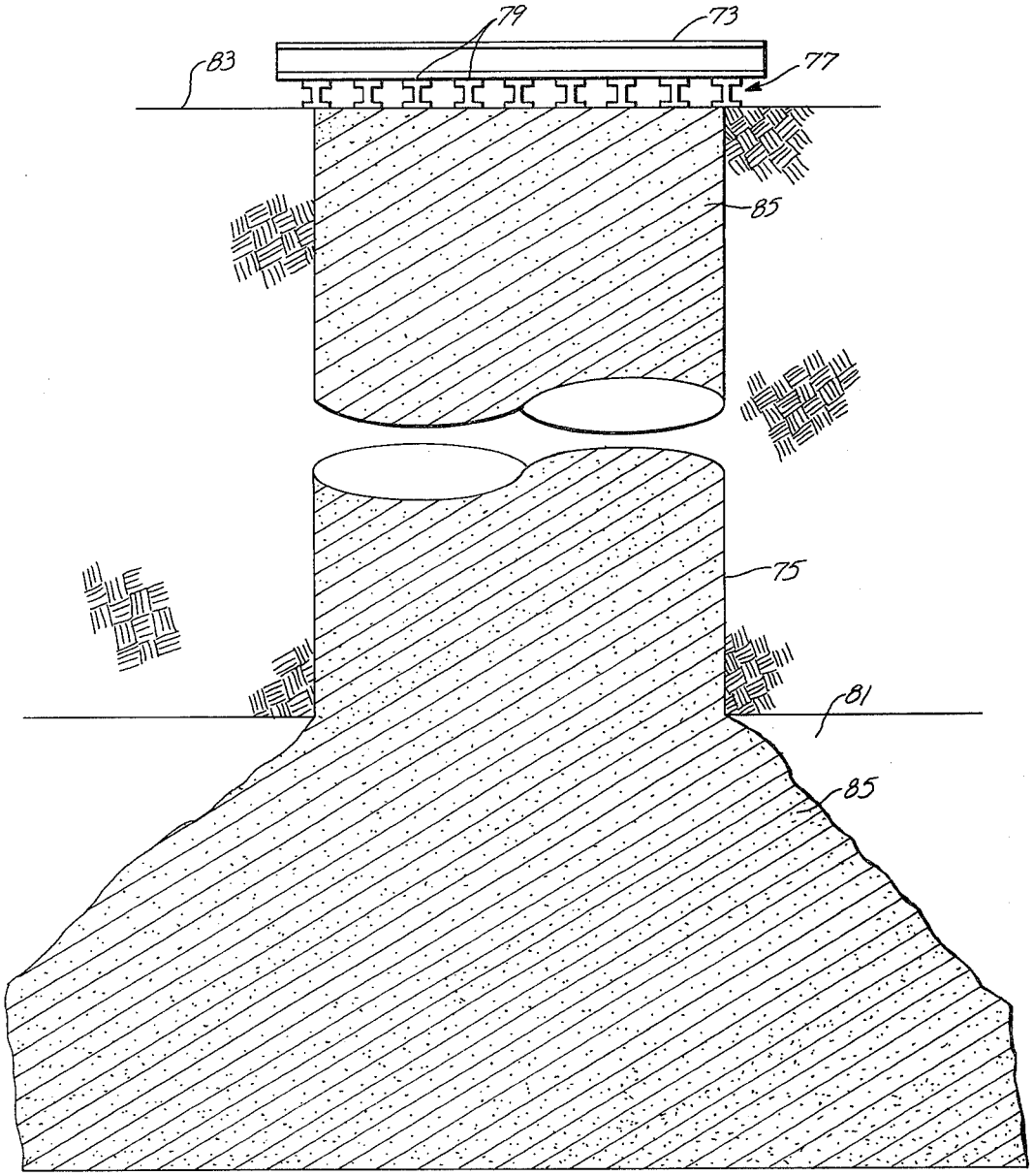
FIG. 4 is a fragmentary, semi-schematic horizontal cross-sectional view of a lower portion of an in situ retort illustrating alternative means for withdrawing gaseous products from a production level drift.

FIG. 4 shows an alternative embodiment in which steel pipes 72, or other conduits are laid on the floor of the principal portion of the production level drift beneath the fragmented mass of particles in the passages 146*a* and 146*b*. These pipes can be just long enough to extend beyond opposite sides of the fragmented mass of particles at the floor region of the production level drift, so that off gas passing through the drift from the other product withdrawal passages bypasses each fragmented mass of particles below the passages 146*a* and 146*b*.

FIG. 5 shows an alternative arrangement in which the product withdrawal passages overlying the portion of the production level drift through which other collected off gas passes are formed with a smaller horizontal cross-sectional area for gas flow than the other passages. This embodiment also illustrates that the product withdrawal passages can be rectangular or square in horizontal cross-section. In this embodiment, a central raise 246*a* has a smaller area than the outer raise 246*c* and the intermediate raises 246*d;* and an inner raise 46*b* nearest the access drift has a smaller area than the central raise 246*a*. None of the passages, at the level where they open through the floor of the lower level void, has a width smaller than the width of the production level drift below it. In the illustrated arrangement, the passages or raises are progressively smaller in area as the amount of off gas travelling in the production level drift beneath the raises increases, so that the pressure drop tends to be equalized amongst the passages or raises.

In other embodiments, a different number and different patterns of product withdrawal passages can be provided, other than the "five-spot" pattern illustrated in FIGS. 1 through 5. For example, a "four-spot" pattern (not shown) can be used where the raises are arranged as illustrated in FIG. 2, except that the central raise is eliminated. Another five-spot pattern (not shown) can be used, in which four product withdrawal passages are located near the corners of the square horizontal cross-section of the retort, with a fifth product withdrawal passage near the center of the retort.

FIG. 6 showns a further alternative comprising a nine-spot pattern having a symmetrical arrangement of nine separate rectangular product withdrawal passages 374 uniformly distributed in three rows, with three passages per row, across the horizontal cross-section of the retort. The embodiment of FIG. 6 also illustrates an arrangement in which the product withdrawal passages communicate with stub drifts 376 arranged so that off gas does not need to pass through a fragmented mass below another product withdrawal passage. In this arrangement, a pair of parallel principal product withdrawal drifts 378 extend below adjacent rows of passages, and off gas is conducted from the stub drifts 376 into the pair of principal drifts 378 for withdrawing off gas from each of the product withdrawal passages 374 independently of passage of off gas below any other passage in the system. Such patterns can be readily expanded for uniformly distributing gas withdrawal passages across the lower boundary of a retort having a greater length than width.

Figure 7:
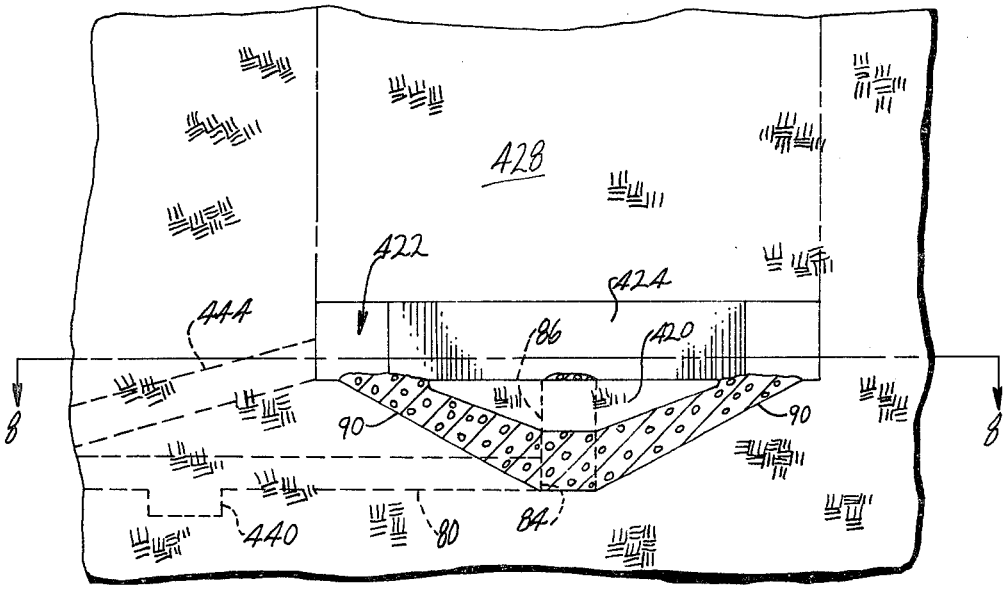
FIG. 7 is a fragmentary, semi-schematic vertical cross-sectional view taken on line 7—7 of FIG. 8 and showing use of diagonal product withdrawal passages at the bottom of an in situ retort.
Figure 8:
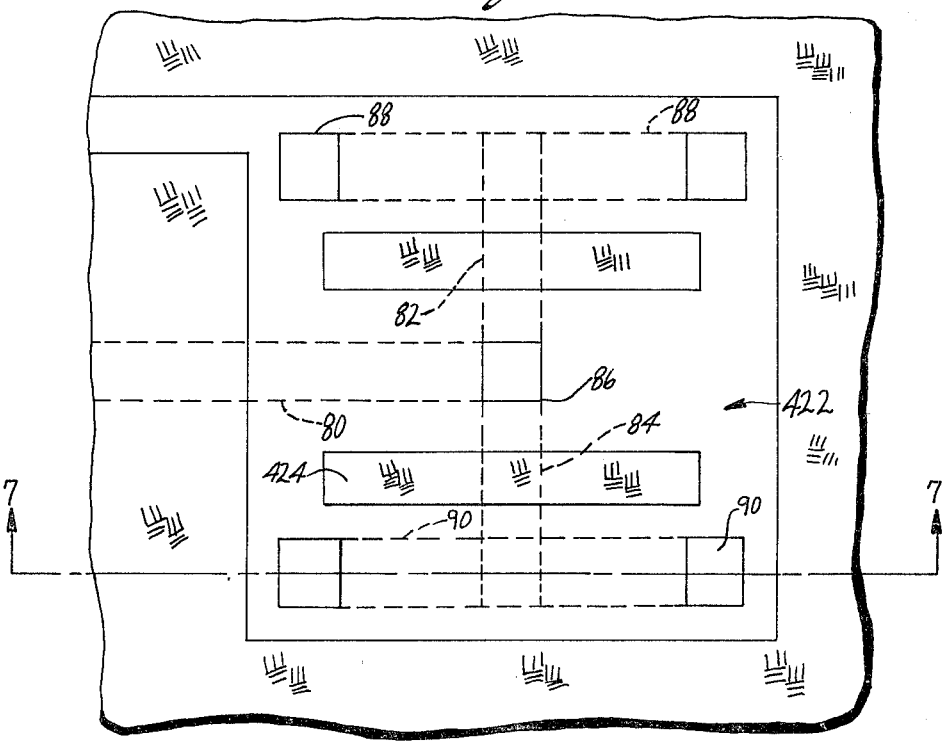
FIG. 8 is a fragmentary, semi-schematic horizontal cross-sectional view taken on line 8—8 of FIG. 7.

FIGS. 7 and 8 show another embodiment in which the product withdrawal passages are arranged on a five-spot pattern, with four diagonally extending gas withdrawal passages intersecting the lower level void and the four corners of the square cross-section of the retort. A fifth passage near the center of the retort extends vertically into the production level drift system. In this embodiment, a generally T-shaped production level drift system comprises a principal drift 80 driven from the access drift to an end near the center of the retort, and a pair of first and second stub drifts 82 and 84, respectively, driven laterally outwardly generally along the center line of the retort in opposite directions from the end of the principal drift. A central product withdrawal passage 86 is excavated vertically upwardly from the end of the principal drift through the floor of the lower level void 422. A first pair of diagonal product withdrawal passages 88 are excavated diagonally upwardly from the end of the first stub drift to inlet openings near two adjacent corners of the lower void. Similarly, a second pair of diagonal product withdrawal passages 90 are excavated diagonally upwardly from the end of the second stub drift to inlet openings near the remaining two corners of the lower void. In the embodiment illustrated in FIGS. 7 and 8, the lower void, as well as the intermediate void and the upper void, are each about 160 feet wide and 160 feet long, and each product withdrawal passage has a width of about 8 to 12 feet, as measured in the horizontal plane at the floor of the lower void. In this embodiment, the total horizontal cross-sectional area to gas flow provided by the passages is at least about 1% of the total horizontal cross-sectional area of the fragmented mass. Preliminary calculations have shown that such an arrangement provides reasonably high efficiency (on the order of 90%) of advancement of a flame front through the fragmented mass. Such an efficiency measurement is with respect to the amount (percentage) of oil shale in the fragmented mass that is contacted by a flame front advanced downwardly through the fragmented mass. This arrangement not only provides good retorting efficiency, but excavation costs also are reasonable, inasmuch as a large production level void below the retort is eliminated.

What is claimed is:

1. A method for recovering liquid and gaseous products from an in situ oil shale retort in a subterranean formation containing oil shale, such an in situ oil shale retort containing a fragmented permeable mass of formation particles containing oil shale and having upper, lower, and side boundaries, comprising the steps of:

excavating formation from within the retort boundaries for forming a lower void extending generally horizontally across a lower level of the retort site, leaving a first zone of unfragmented formation within the retort boundaries above the lower void;

excavating formation from a production level spaced below the lower void for forming at least one production level drift, leaving a second zone of unfragmented formation between the lower void and the production level drift;

forming a plurality of product withdrawal passages through said second zone of unfragmented formation between the lower void and the production level drift for providing fluid communication between the fragmented mass in the retort and the production level drift, each of said product withdrawal passages containing a permeable mass of particles;

explosively expanding such first zone of unfragmented formation toward at least the lower void for forming a fragmented permeable mass of formation particles containing oil shale within the retort;

withdrawing the mass of particles from the product withdrawal passages;

establishing a retorting zone in an upper portion of the fragmented mass in the retort and advancing the retorting zone through the fragmented mass in the retort for producing liquid and gaseous products of retorting;

passing such liquid and gaseous products of retorting from the fragmented mass in the retort through each of such a plurality of empty product withdrawal passages to the production level drift; and withdrawing such products of retorting from the production level drift.

2. The method according to claim 1 wherein the product withdrawal passages are spaced apart across the horizontal cross section of the lower void for withdrawing products of retorting from separate locations spaced apart across the horizontal cross section of the fragmented mass in the retort.

3. The method according to claim 1 comprising forming such a product withdrawal passage with a larger horizontal cross-sectional area adjacent the lower void and a smaller horizontal cross-sectional area adjacent the production level drift.

4. The method according to claim 1 comprising filling at least a portion of the production level drift with a mass of particles prior to explosive expansion of the first zone of unfragmented formation for supporting the mass of particles in each product withdrawal passage during such explosive expansion, withdrawing the mass of particles from the production level drift after such explosive expansion.

5. The method according to claim 1 comprising forming the product withdrawal passages with a total cross-sectional area for gas flow that is greater than about 1% of the horizontal cross-sectional area of the fragmented mass in the retort.

6. The method according to claim 1 comprising forming the production level drift with a horizontal cross-sectional area less than the horizontal cross-sectional area of the fragmented mass in the retort.

7. The method according to claim 1 comprising forming a plurality of production level drifts each communicating with at least one product withdrawal passage.

8. The method according to claim 1 including backfilling each of a plurality of such product withdrawal passages with a mass of particles up to the vicinity of the lower level void prior to explosive expansion of the first zone of unfragmented formation.

9. The method according to claim 1 comprising forming the production level drift with a plurality of branch drifts each communicating with at least one product withdrawal passage, and at least one principal drift communicating with such branch drifts for withdrawing products of retorting from the branch drifts.

10. The method according to claim 9 comprising forming the principal drift with a cross-section for gas flow that is greater than the cross section for gas flow through such a branch drift.

11. The method according to claim 1 including placing means for inhibiting flow of particles into such a product withdrawal passage at the top of such a product withdrawal passage.

12. A method for recovering liquid and gaseous products from an in situ oil shale retort, such an in situ oil shale retort in a subterranean formation, such as in situ oil shale retort containing a fragmented permeable mass of formation particles containing oil shale and having upper, lower and side boundaries, comprising the steps of:

excavating formation from within the retort boundaries for forming a lower void extending generally horizontally across a lower level of the retort site, leaving a first zone of unfragmented formation within the retort boundaries above the lower void;

excavating formation from a production level spaced below the lower void for forming at least one production level drift, leaving a second zone of unfragmented formation between the lower void and the production level drift;

forming a plurality of product withdrawal passages through said second zone of unfragmented formation between the lower void and the production level drift for providing fluid communication between the fragmented mass in the retort and the production level drift, each of said product withdrawal passages containing a permeable mass of particles;

explosively expanding such first zone of unfragmented formation toward at least the lower void for forming a fragmented permeable mass of formation particles containing oil shale within the retort, wherein the mass of particles in each of the product withdrawal passages has a void fraction which is greater than the void fraction of the fragmented mass of particles in the retort;

establishing a retorting zone in an upper portion of the fragmented mass in the retort and advancing the retorting zone through the fragmented mass in the retort for producing liquid and gaseous products of retorting;

passing such liquid and gaseous products of retorting from the fragmented mass in the retort through each of such a plurality of product withdrawal passages to the production level drift; and withdrawing such products of retorting from the production level drift.

13. The method according to claim 12 comprising excavating a plurality of such product withdrawal passages extending diagonally upwardly between the product withdrawal drift and locations mutually spaced apart across the horizontal cross section of the lower void.

14. The method according to claim 12 comprising forming the product withdrawal passages so they extend to a plurality of locations mutually spaced apart across the horizontal cross section of the production level drift; and including conveying the gaseous products of retorting from the product withdrawal passages through the production level drift from each of a plurality of such locations past gaseous products entering the production level drift from the other of such locations in the production level drift.

15. The method according to claim 12 including placing at least one gas collection conduit in the production level drift for withdrawing off gas from at least one such product withdrawal passage independently of gas flow in the production level drift from another such product withdrawal passage.

16. A method for forming an in situ oilshale retort in a subterranean formation containing oil shale, such an in situ oil shale retort containing a fragmented permeable mass of formation particles containing oil shale within upper, lower and side boundaries of unfragmented formation comprising the steps of:

excavating formation from within the retort boundaries for forming at least one retort level void extending horizontally across a lower level of the retort adjacent to the bottom boundary, leaving at least one remaining portion of unfragmented formation within the boundaries of the retort and having a horizontally extending free face overlying such a void;

excavating at least one production level drift in formation below the retort level void, leaving a lower zone of unfragmented formation between the bottom boundary of the retort and the production level drift;

excavating a plurality of product withdrawal passages extending through said lower zone of unfragmented formation from the retort level void to such production level drift for providing fluid communication from the retort to the production level drift, said product withdrawal passages being mutually spaced apart across the horizontal cross section of the retort being formed;

placing a permeable mass of particles in each of such product withdrawal passages;

explosively expanding such remaining portion of unfragmented formation toward at least the retort level void for forming a fragmented permeable mass of formation particles containing oil shale within the upper, lower, and side boundaries of the retort site; and removing the masses of particles from such product withdrawal passages after said explosive expansion step.

17. The method according to claim 16 comprising the step of placing a grizzly at the top of each product withdrawal passage prior to the explosive expansion step.

18. The method according to claim 16 in which the horizontal cross-sectional area of the production level drift is less than the horizontal cross-sectional area of the fragmented mass in the retort.

19. The method according to claim 16 comprising forming a plurality of such product withdrawal passages so that they communicate with a single production level drift.

20. A method for forming an in situ oil shale retort in a subterranean formation containing oil shale, such an in situ oil shale retort containing a fragmented permeable mass of formation particles containing oil shale within upper, lower and side boundaries of unfragmented formation comprising the steps of:

excavating formation from within the retort boundaries for forming at least one retort level void extending horizontally across a lower level of the retort adjacent to the bottom boundary, leaving at least one remaining portion of unfragmented formation within the boundaries of the retort and having a horizontally extending free face overlying such a void;

excavating at least one production level drift in formation below the retort level void, leaving a lower zone of unfragmented formation between the bottom boundary of the retort and the production level drift;

excavating a plurality of product withdrawal passages extending through said lower zone of unfragmented formation from the retort level void to such production level drift for providing fluid communication from the retort to the production level drift, said product withdrawal passages being mutually spaced apart across the horizontal cross section of the retort being formed;

placing a permeable mass of particles in each of such product withdrawal passages;

explosively expanding such remaining portion of unfragmented formation toward at least the retort level void for forming a fragmented permeable mass of formation particles containing oil shale within the upper, lower, and side boundaries of the retort site;

placing a grizzly at the top of each product withdrawal passage prior to the explosive expansion step; and removing the masses of particles from such product withdrawal passages after said explosive expansion step.

21. A method for forming an in situ oil shale retort in a subterranean formation containing oil shale, such an in situ oil shale retort having a top boundary, a bottom boundary, and generally vertically extending side boundaries of unfragmented formation and containing a fragmented permeable mass of formation particles containing oil shale, the method comprising the steps of:

excavating a lower void extending across the lower boundary of the retort, leaving a remaining zone of unfragmented formation within the side boundaries above the lower void;

excavating a production level drift below the lower boundary of the retort, leaving a lower zone of unfragmented formation between the lower void and the production level drift;

excavating a plurality of product withdrawal passages through the lower zone of unfragmented formation between the bottom boundary of the retort and such a production level drift;

filling each of said product withdrawal passages with a permeable mass of particles;

explosively expanding such a remaining zone of unfragmented formation toward at least the lower void for forming such a fragmented permeable mass of formation particles containing oil shale within the retort;

withdrawing the permeable mass of particles from such product withdrawal passage after the explosive expansion step;

establishing a retorting zone in an upper portion of the fragmented mass in the retort and advancing the retorting zone through the fragmented mass in the retort for producing liquid and gaseous products of retorting;

passing such liquid and gaseous products of retorting from the fragmented mass in the retort through each of such a plurality of empty product withdrawal passages to the production level drift; and withdrawing such products of retorting from the production level drift.

22. The method according to claim 21 wherein the product withdrawal passages are mutually spaced apart across the horizontal cross section of the lower void for withdrawing products of retorting from locations spaced across the lower portion of the fragmented mass in the retort.

23. The method according to claim 21 comprising passing liquid and gaseous products of retorting from the fragmented mass in the retort through each of a plurality of such product withdrawal passages to the production level drift.

24. The method according to claim 21 comprising forming such a product withdrawal passage with a larger horizontal cross-sectional area adjacent the lower void and a smaller horizontal cross-sectional area adjacent the production level drift.

* * * * *

UNITED STATES PATENT AND TRADEMARK OFFICE

CERTIFICATE OF CORRECTION

PATENT NO. : 4,440,445

DATED : April 3, 1984

INVENTOR(S) : Ned M. Hutchins

It is certified that error appears in the above-identified patent and that said Letters Patent is hereby corrected as shown below:

| | |
|---|---|
| Column 1, line 51, | "with" should be -- within --. |
| Column 3, line 7, | -- retort -- should be inserted after "shale" and before "formed". |
| Column 4, line 33, | "ilustrated" should be -- illustrated --. |
| Column 8, line 36, | after "passages" the period should be deleted. |
| Column 9, line 60, | "frgmented" should be -- fragmented --. |
| Column 10, line 46, | "showns" should be -- shows --. |
| Column 12, line 67, | "such an in situ oil shale retort" should be deleted. |
| Column 12, line 68, | "as" should be -- an --. |

Signed and Sealed this

*Fourth* Day of *December 1984*

[SEAL]

*Attest:*

GERALD J. MOSSINGHOFF

*Attesting Officer* *Commissioner of Patents and Trademarks*